US008506045B2

(12) United States Patent
Ko et al.

(10) Patent No.: US 8,506,045 B2
(45) Date of Patent: Aug. 13, 2013

(54) INKJET HEAD CLEANING APPARATUS AND METHOD

(75) Inventors: Kang Woong Ko, Seoul (KR); Hyun Cheol Oh, Pyeongtaek-si (KR); Dong Eog Kim, Suwon-si (KR); Dae Jung Kim, Seoul (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 13/277,267

(22) Filed: Oct. 20, 2011

(65) Prior Publication Data

US 2012/0120151 A1 May 17, 2012

(30) Foreign Application Priority Data

Nov. 12, 2010 (KR) ..... 10-2010-0112378

(51) Int. Cl.
*B41J 2/165* (2006.01)

(52) U.S. Cl.
USPC ..... 347/33

(58) Field of Classification Search
USPC ..... 347/33
See application file for complete search history.

(56) References Cited

U.S. PATENT DOCUMENTS

| | | | | |
|---|---|---|---|---|
| 5,602,573 | A * | 2/1997 | Waschhauser et al. | 347/33 |
| 5,949,454 | A * | 9/1999 | Nozawa et al. | 347/45 |
| 6,921,146 | B2 * | 7/2005 | Wouters | 347/33 |
| 7,387,359 | B2 * | 6/2008 | Hernandez et al. | 347/29 |
| 2001/0043251 | A1 * | 11/2001 | Beachnau Hood et al. | 347/33 |
| 2002/0024569 | A1 * | 2/2002 | Silverbrook | 347/85 |
| 2002/0085059 | A1 * | 7/2002 | Sharma et al. | 347/28 |
| 2003/0085960 | A1 * | 5/2003 | Kim et al. | 347/65 |
| 2004/0189735 | A1 * | 9/2004 | Ishii et al. | 347/22 |
| 2004/0233248 | A1 * | 11/2004 | Ahne et al. | 347/40 |
| 2007/0146424 | A1 | 6/2007 | Umeda | |
| 2007/0252863 | A1 * | 11/2007 | Sun et al. | 347/28 |
| 2007/0256709 | A1 * | 11/2007 | Shang et al. | 134/18 |
| 2007/0268330 | A1 * | 11/2007 | Zengo et al. | 347/33 |
| 2008/0122892 | A1 * | 5/2008 | Sakamoto | 347/33 |
| 2010/0079540 | A1 * | 4/2010 | Hirato | 347/33 |
| 2010/0214356 | A1 * | 8/2010 | Maida et al. | 347/28 |

FOREIGN PATENT DOCUMENTS

| | | |
|---|---|---|
| JP | 2006212870 A | 8/2006 |
| JP | 2007175906 A | 7/2007 |

* cited by examiner

*Primary Examiner* — Matthew Luu
*Assistant Examiner* — Alexander D Shenderov
(74) *Attorney, Agent, or Firm* — Harness, Dickey & Pierce, P.L.C.

(57) ABSTRACT

According to an example embodiment, an inkjet head cleaning apparatus that removes ink residue from an inkjet head after a purging operation in a non-contact manner includes a cleaning blade and a drive unit. The cleaning blade is at a distance from a bottom of the inkjet head. The drive unit is configured to move the cleaning blade in a direction parallel to the inkjet head bottom. The cleaning blade includes a flat upper surface parallel to the inkjet head bottom, and an ink film is produced between the flat upper surface of the cleaning blade and the inkjet head bottom. The cleaning blade also includes an elongated groove longitudinally in the upper surface of the cleaning blade.

12 Claims, 6 Drawing Sheets

CONVENTIONAL ART

INKJET HEAD CLEANING APPARATUS AND METHOD

CROSS-REFERENCE TO RELATED APPLICATION

This application claims priority under 35 U.S.C. §119 to Korean Patent Application No. 2010-0112378, filed on Nov. 12, 2010 in the Korean Intellectual Property Office (KIPO), the entire contents of which is incorporated herein by reference.

BACKGROUND

1. Field

Example embodiments relate to an inkjet head cleaning apparatus and method to clean an inkjet head.

2. Description of the Related Art

Inkjet technology is used in various stages of the manufacture of Liquid Crystal Displays (LCDs). In equipment using inkjet technology, maintenance of an inkjet head is an essential process to assure uniform discharge of ink and preventing clogging of nozzles of the inkjet head.

Generally, if an inkjet head contains a clogged nozzle, a purging process, in which ink is forced through the nozzle, is performed. Such purging cleans a clogged nozzle. Then, ink residue on the inkjet head after purging is removed using a wiper. FIG. 5 is a schematic side view illustrating a conventional inkjet head cleaning apparatus using a wiper. As illustrated in FIG. 5, ink residue 10 on a bottom 150 of an inkjet head 100 after purging may be removed using a wiper 5. However, this cleaning method may require that the wiper 5 come in contact with the bottom 150 of the inkjet head 100, causing damage to the head bottom 150 after extended use. In addition, the wiper 5 is expendable and may need to be periodically exchanged.

SUMMARY

According to an example embodiment, an inkjet head cleaning apparatus that removes ink residue from an inkjet head after a purging operation in a non-contact manner includes a cleaning blade and a drive unit. The cleaning blade is at a distance from a bottom of the inkjet head. The drive unit is configured to move the cleaning blade in a direction parallel to the inkjet head bottom. The cleaning blade includes a flat upper surface parallel to the inkjet head bottom, and an ink film is produced between the flat upper surface of the cleaning blade and the inkjet head bottom. The cleaning blade also includes an elongated groove longitudinally in the upper surface of the cleaning blade.

According to an example embodiment, the inkjet head bottom is surface treated to allow the ink residue from the inkjet head bottom to form ink droplets and prevent spreading of the ink residue over the inkjet head bottom.

According to an example embodiment, the inkjet head bottom is coated by hydrophobic treatment based on the viscosity of the ink residue on the inkjet head bottom.

According to an example embodiment, at least one surface of the elongated groove is subjected to hydrophilic treatment.

According to an example embodiment, a lateral surface of the cleaning blade has a trapezoidal shape having oblique left and right sides, a short upper side facing the inkjet head bottom and a long lower side.

According to an example embodiment, the elongated groove in the upper surface of the cleaning blade has a length greater than a width of all nozzles at the inkjet head bottom.

According to an example embodiment, the cleaning blade is spaced apart from the inkjet head bottom by the distance such that the ink film is produced between the inkjet head bottom and the upper surface of the cleaning blade.

According to an example embodiment, the apparatus further includes an ink supply/discharge portion configured to supply ink into the elongated groove or configured to discharge the ink collected in the elongated groove.

According to an example embodiment, an inkjet head cleaning method includes positioning a cleaning blade including an upper surface parallel to an inkjet head bottom at a distance from the inkjet head bottom, forming an ink film between the inkjet head bottom and the cleaning blade using an elongated groove in the upper surface of the cleaning blade, and removing ink from the inkjet head bottom in a non-contact manner after a purging operation by moving the cleaning blade.

According to an example embodiment, the method further includes coating the inkjet head bottom.

According to an example embodiment, the inkjet head bottom is coated by hydrophobic treatment.

According to an example embodiment, the method further includes coating the elongated groove in the cleaning blade by hydrophilic treatment.

BRIEF DESCRIPTION OF THE DRAWINGS

The above and other features and advantages will become more apparent by describing in detail example embodiments with reference to the attached drawings. The accompanying drawings are intended to depict example embodiments and should not be interpreted to limit the intended scope of the claims. The accompanying drawings are not to be considered as drawn to scale unless explicitly noted.

DETAILED DESCRIPTION

Figure 1:
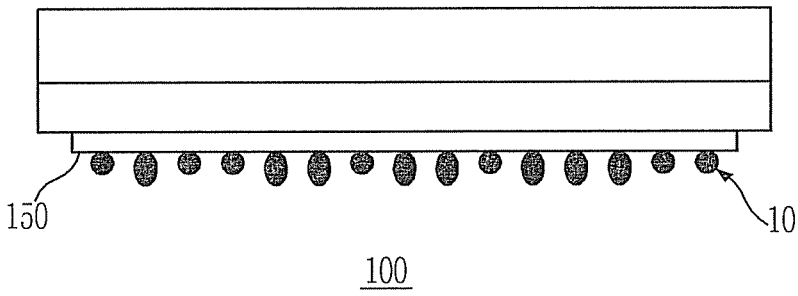
FIG. 1 is a schematic diagram illustrating residual ink droplets on an inkjet head after purging.

Example embodiments will now be described more fully with reference to the accompanying drawings, in which example embodiments are shown. Example embodiments may, however, be embodied in many different forms and should not be construed as being limited to the embodiments set forth herein; rather, these embodiments are provided so that this disclosure will be thorough and complete, and will fully convey the concept of example embodiments to those of ordinary skill in the art. In the drawings, the thicknesses of layers and regions are exaggerated for clarity. Like reference numerals in the drawings denote like elements, and thus their description will be omitted.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like numbers indicate like elements throughout. As used herein the term "and/or" includes any and all combinations of one or more of the associated listed items. Other words used to describe the relationship between elements or layers should be interpreted in a like fashion (e.g., "between" versus "directly between," "adjacent" versus "directly adjacent," "on" versus "directly on").

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle may have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

FIG. 1 is a schematic diagram illustrating residual ink droplets on an inkjet head after purging.

Purging is a process to clean a clogged nozzle exhibiting poor (for example, non-uniform) ink discharge using pressure. In one example, high-pressure air is used to clean the clogged nozzle.

After cleaning the clogged nozzle using purging, however, ink residue 10 may be present on a bottom 150 of an inkjet head 100 as illustrated in FIG. 1 due to the viscosity and/or surface tension of ink and/or structural limits of the nozzle.

If ink residue 10 is present around the nozzle, this may prevent smooth discharge of ink. To assure uniform ink discharge, it may be desirable to remove the ink residue 10 from the inkjet head bottom 150.

According to an example embodiment, an inkjet head cleaning apparatus cleans the inkjet head bottom 150 in a non-contact manner. Cleaning the inkjet head 100 in a non-contact manner may prevent physical damage to the inkjet head 100.

After purging, ink residue 10 may remain on the head bottom 150 around the nozzle. The presence of ink residue 10 hanging from the head bottom 150 may prevent discharge of ink, or may cause ink injected through the nozzle to reach an incorrect position and/or an incorrect amount of ink to be injected. This may deteriorate performance of the inkjet head 100 and thus, removal of the ink residue 10 may be desirable.

Figure 2:
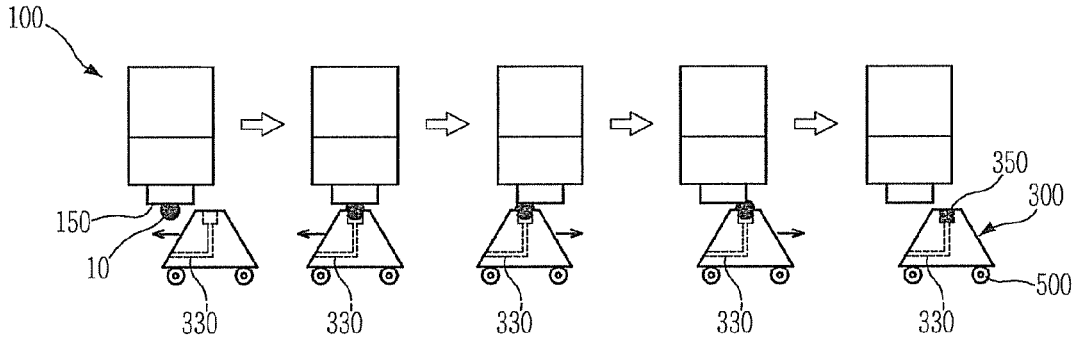
FIG. 2 is a schematic diagram illustrating the operation sequence of an inkjet head cleaning apparatus according to an example embodiment.

FIG. 2 is a schematic diagram illustrating the operation sequence of the inkjet head cleaning apparatus according to an example embodiment.

The inkjet head cleaning apparatus includes a cleaning blade 300 to remove the ink residue 10 from the bottom 150 of the inkjet head 100 and a drive unit 500.

The inkjet head 100 includes one or more ink injection nozzles, nozzle tips being located on the flat inkjet head bottom 150.

The inkjet head bottom 150 may be subjected to surface treatment to assure easy removal of the ink residue 10. For example, the inkjet head bottom 150 may be coated via hydrophobic surface treatment.

Through hydrophobic surface treatment of the inkjet head bottom 150, the ink residue 10 from the inkjet head bottom 150 may form ink droplets rather than spreading. The ink droplets 10 may be easily removed by the cleaning blade 300 of the inkjet head cleaning apparatus.

Now, the cleaning blade 300 of the inkjet head cleaning apparatus will be described with reference to FIGS. 2 to 4.

Figure 4:
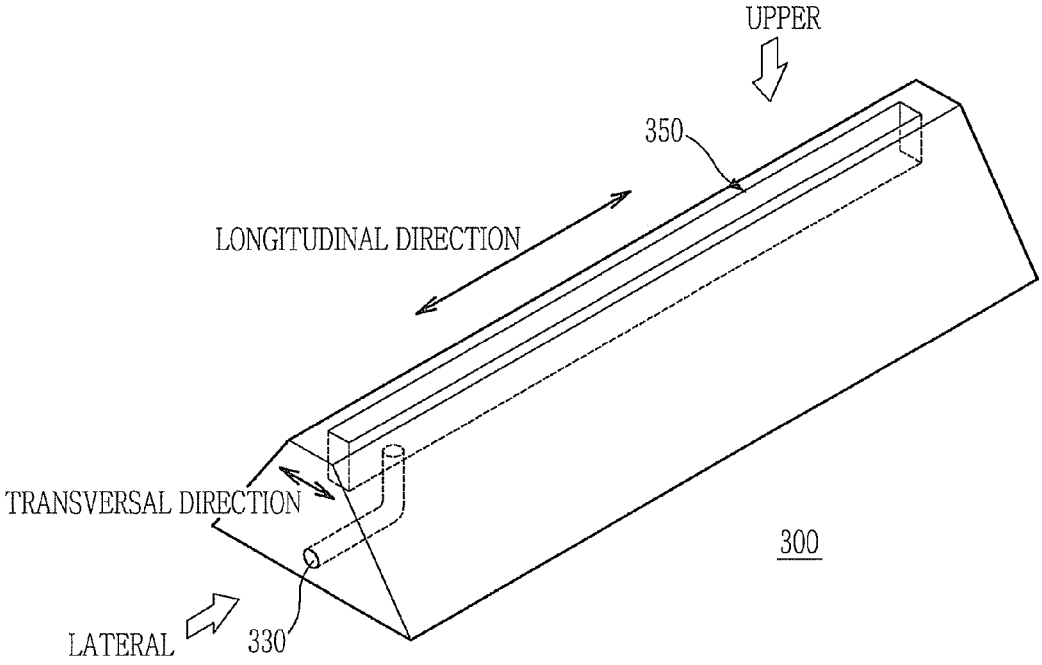
FIG. 4 is a perspective diagram of the cleaning blade included in the inkjet head cleaning apparatus according to an example embodiment.
Figure 5:
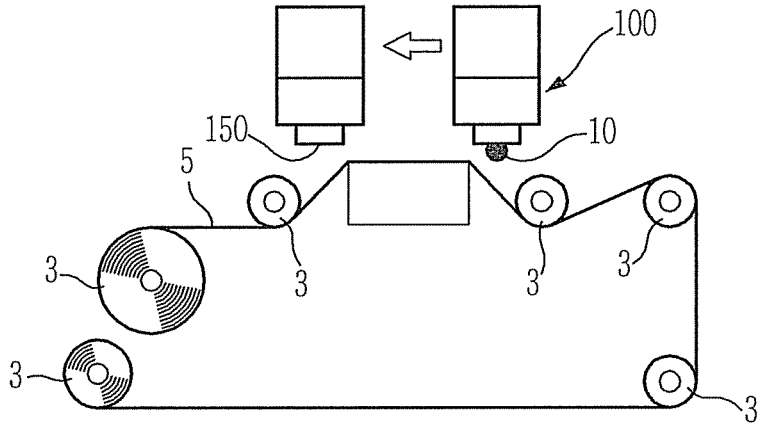
FIG. 5 is a schematic side diagram illustrating a conventional inkjet head cleaning apparatus using a wiper.

FIG. 4 is a perspective diagram of the cleaning blade included in the inkjet head cleaning apparatus according to an example embodiment.

As illustrated in FIG. 4, an upper surface of the cleaning blade 300 is provided with a longitudinally elongated groove 350 and a lateral surface of the cleaning blade 300 has a trapezoidal shape.

The cleaning blade 300 removes the ink residue 10 from the inkjet head bottom 150 without coming into contact with the inkjet head bottom 150. The upper surface of the cleaning blade 300 is a flat surface parallel to the inkjet head bottom 150.

The groove 350 is longitudinally formed in the center of the upper surface of the cleaning blade 300 and has a desired (or, alternatively predetermined) width. The groove 350 allows an ink film 15 to be produced between the upper surface of the cleaning blade 300 and the inkjet head bottom 150, enabling removal of the ink residue 10 from the bottom 150 of the inkjet head 100 in a non-contact manner.

In the groove 350 in the upper surface of the cleaning blade 300, a longer side thereof corresponds to a longitudinal direction and a shorter side thereof corresponds to a transversal direction.

A depth of the groove 350 in the upper surface of the cleaning blade 300 may be smaller than a distance between upper and lower surfaces of the cleaning blade 300. That is, the depth of the groove 350 may be smaller than a height of the cleaning blade 300, in order to allow the ink film 15 to be easily produced between the cleaning blade 300 and the inkjet head bottom 150.

Also, a longitudinal length of the groove 350 in the upper surface of the cleaning blade 300 may be greater than an arrangement length of all the nozzles of the inkjet head 100. This serves to effectively remove the ink residue 10 from the inkjet head bottom 150. The longitudinal length of the groove 350 may be greater than the arrangement length of all the nozzles, in order to allow the ink film 15 to be easily produced between the cleaning blade 300 and the inkjet head bottom 150 and to completely remove the ink residue 10 from the inkjet head 100.

The groove 350 in the upper surface of the cleaning blade 300 may be coated via hydrophilic surface treatment to allow ink present in the groove 350 to effectively remove the ink residue 10 from the inkjet head bottom 150.

The lateral surface of the cleaning blade 300 may have a trapezoidal shape having oblique left and right sides, a short upper side facing the inkjet head bottom 150 and a long lower side. The trapezoidal shape may assist the ink residue to move down, facilitating self-cleaning of the cleaning blade 300.

The cleaning blade 300 may further include an ink supply/discharge portion 330 to supply ink into the groove 350 or discharge the ink collected in the groove 350.

When ink is supplied into the groove 350 through the ink supply/discharge portion 330, the supplied ink forms the ink film 15 between the inkjet head bottom 150 and the cleaning blade 300 so as to remove the ink residue 10 from the inkjet head bottom 150.

If the ink residue 10 collected in the groove 350 exceeds a desired (or, alternatively predetermined) amount, the ink present in the groove 350 is discharged through the ink supply/discharge portion 330.

The drive unit 500 moves the cleaning blade 300. To allow the cleaning blade 300 to remove the ink residue 10 from the inkjet head bottom 150, the drive unit 500 moves the cleaning blade 300 in a direction parallel to the inkjet head bottom 150.

The drive unit 500, as illustrated in FIG. 2, reciprocates the cleaning blade 300 in a direction parallel to the inkjet head bottom 150, allowing the cleaning blade 300 to remove the ink residue 10 from the inkjet head bottom 150.

Next, an operation to clean the inkjet head bottom 150 using the inkjet head cleaning apparatus according to an example embodiment will be described with reference to FIGS. 2 and 3.

Figure 3:
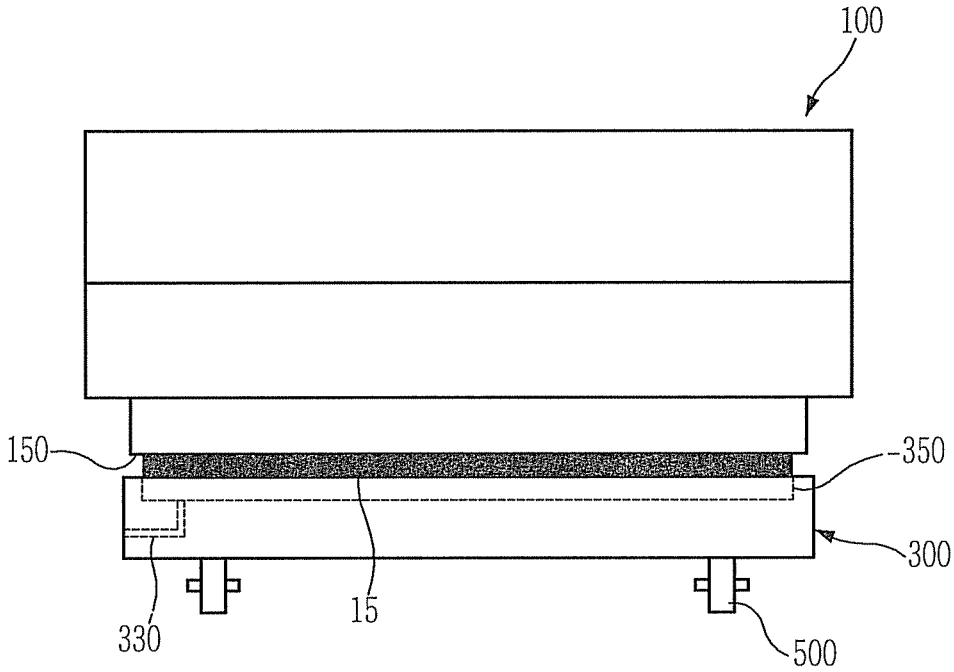
FIG. 3 is a side diagram illustrating an ink film between an inkjet head bottom and a cleaning blade of the inkjet head cleaning apparatus according to an example embodiment.

FIG. 3 is a side diagram illustrating the ink film between the inkjet head bottom and the cleaning blade of the inkjet head cleaning apparatus according to an example embodiment.

First, the cleaning blade 300 is installed to move in a direction parallel to the inkjet head bottom 150 while keeping a desired (or, alternatively predetermined) distance from the inkjet head bottom 150 to allow the ink residue 10 from the inkjet head bottom 150 to produce the ink film 15 by operation of the cleaning blade 300.

Next, as the inkjet head 100 is purged, ink discharged from the nozzle may remain as ink residue 10 on the inkjet head bottom 150 due to surface tension of ink and/or gravity.

To remove the ink residue 10, the cleaning blade 300 performs cleaning to wipe the ink residue 10 from the inkjet head bottom 150 while being horizontally moved by the drive unit 500.

While the cleaning blade 300 wipes the inkjet head bottom 150, as illustrated in FIG. 3, a uniform ink film 15 is produced between the inkjet head bottom 150 and the upper surface of the cleaning blade 300 owing to the presence of the elongated groove 350 formed in the upper surface of the cleaning blade 300.

After performing the cleaning, the cleaning blade 300 is again moved in an opposite direction by the drive unit 500.

Through the above described process, the uniform ink film 15 between the inkjet head bottom 150 and the upper surface of the cleaning blade 300 may remove fine ink droplets present on the inkjet head bottom 150.

Alternatively, differently from the above-described method, the ink film 15 may be produced as the cleaning blade 300 wipes the inkjet head bottom 150 while being moved by the drive unit 500. Specifically, if purging is performed in a state in which the cleaning blade 300 is located (for example, in a stationary manner) immediately below the inkjet head bottom 150, a uniform ink film 15 may be produced between the inkjet head bottom 150 and the upper surface of the cleaning blade 300.

Alternatively, the ink film 15 may be produced between the inkjet head bottom 150 and the upper surface of the cleaning blade 300 as ink is supplied into the elongated groove 350 of the cleaning blade 300 through the ink supply/discharge portion 330 during movement of the cleaning blade 300 or when the cleaning blade 300 is located immediately below the inkjet head bottom 150. The ink film 15 produced by the above-described methods may act to absorb the ink residue 10 from the inkjet head bottom 150 into the groove 350 during movement of the cleaning blade 300, completing cleaning of the inkjet head bottom 150.

Here, the principle of removing the ink residue 10 from the inkjet head bottom 150 using the elongated groove 350 in the cleaning blade 300 will be described as follows.

Assuming that the elongated groove 350 is not in the upper surface of the cleaning blade 300, the ink residue 10 tends to form ink droplets by surface tension between the upper surface of the cleaning blade 300 and the inkjet head bottom 150, rather than forming a uniform ink film.

However, as a result of the elongated groove 350 in the cleaning blade 300, the elongated groove 350 is filled with ink when the ink residue 10 from the inkjet head bottom 150 comes into contact with the cleaning blade 300. Here, the groove 350 is filled with ink supplied through the ink supply/discharge portion 330 and the upper surface of the cleaning blade 300 exhibits super hydrophilic properties.

That is, the groove 350 in the upper surface of the cleaning blade 300 facilitates production of the uniform ink film 15 between the cleaning blade 300 and the inkjet head bottom 150. Also, the ink present in the groove 350 acts to absorb the ink residue 10. Consequently, the ink residue 10 hanging from the inkjet head bottom 150 may be removed by the cleaning blade 300.

Figure 6:
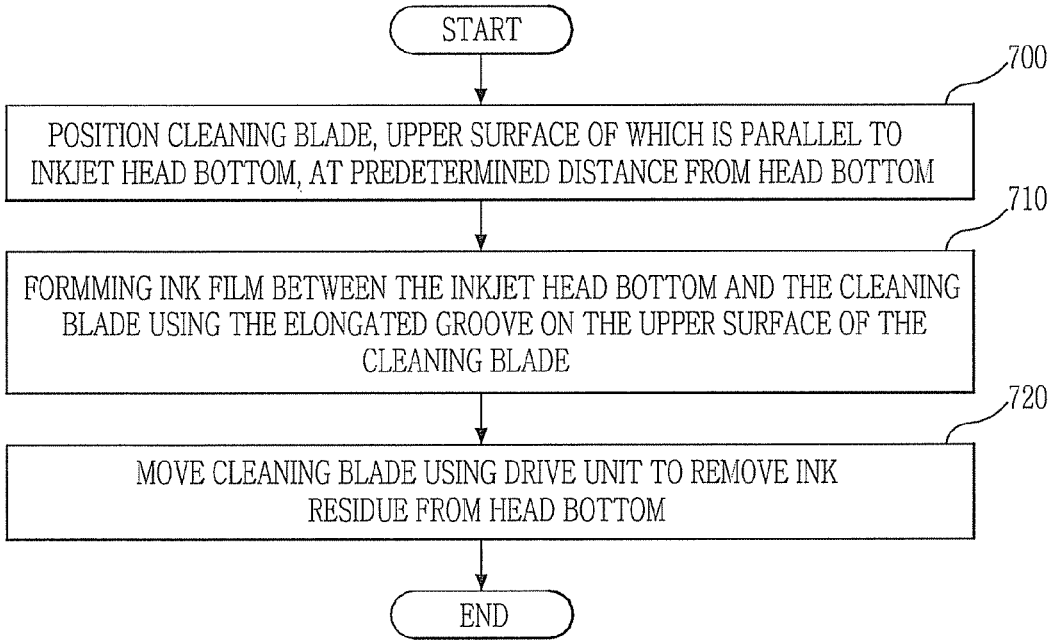
FIG. 6 is a flow chart illustrating the sequence of an inkjet head cleaning method according to an example embodiment.

FIG. 6 is a flow chart illustrating the sequence of an inkjet head cleaning method according to an example embodiment.

First, the cleaning blade 300, the upper surface of which is parallel to the inkjet head bottom 150, is positioned at a desired (or, alternatively predetermined) distance from the inkjet head bottom 150 (700). Next, the ink film 15 is produced between the inkjet head bottom 150 and the cleaning blade 300 using the elongated groove 350 in the upper surface of the cleaning blade 300 (710). Next, the cleaning blade 300 is moved by the drive unit 500 so as to remove the ink residue 10 from the inkjet head bottom 150 (720). In this case, ink is supplied into the elongated groove 350 in the upper surface of the cleaning blade 300 through the ink supply/discharge portion 300. As the supplied ink absorbs the ink residue 10 from the inkjet head bottom 150, cleaning of the inkjet head bottom 150 is performed.

As is apparent from the above description, in an inkjet head cleaning apparatus and method according to an example embodiment, an inkjet head may be cleaned in a non-contact manner. This enables semi-permanent use of a cleaning blade, preventing damage to the inkjet head, and assuring minimal ink residue on the inkjet head after cleaning. Moreover, the semi-permanent cleaning blade may reduce production costs and time.

While example embodiments have been particularly shown and described, it will be understood by one of ordinary skill in the art that variations in form and detail may be made therein without departing from the spirit and scope of the claims.

What is claimed is:

1. An inkjet head cleaning apparatus for removing ink residue from an inkjet head after a purging operation in a non-contact manner, comprising:

a cleaning blade at a distance from a bottom of the inkjet head, the cleaning blade including, a flat upper surface parallel to the inkjet head bottom, and an elongated groove longitudinally defined in the flat upper surface of the cleaning blade, the inkjet head cleaning apparatus configured to supply ink into the elongated groove; and a drive unit configured to move the cleaning blade in a direction parallel to the inkjet head bottom.

2. The apparatus according to claim 1, further comprising: a hydrophobic coating on the inkjet head bottom.

3. The apparatus according to claim 1, further comprising: a hydrophilic coating on at least one surface of the elongated groove.

4. The apparatus according to claim 1, wherein a lateral surface of the cleaning blade has a trapezoidal shape having oblique left and right sides, a short upper side facing the inkjet head bottom and a long lower side.

5. The apparatus according to claim 1, wherein the elongated groove in the upper surface of the cleaning blade has a length greater than an arrangement length of all nozzles at the inkjet head bottom.

6. The apparatus according to claim 1, wherein the cleaning blade is spaced apart from the inkjet head bottom by the distance such that an ink film is produced between the inkjet head bottom and the upper surface of the cleaning blade.

7. The apparatus according to claim 1, further comprising: an ink supply/discharge portion configured to supply ink into the elongated groove or configured to discharge the ink collected in the elongated groove.

8. The apparatus according to claim 1, wherein the drive unit is configured to move a longitudinal side of the cleaning blade in a direction perpendicular to a longitudinal side of the inkjet head bottom.

9. An inkjet head cleaning method, comprising:

positioning a cleaning blade including an upper surface parallel to an inkjet head bottom at a distance from the inkjet head bottom;

forming an ink film between the inkjet head bottom and the cleaning blade by supplying ink into an elongated groove in the upper surface of the cleaning blade; and removing ink residue from the inkjet head bottom in a non-contact manner after a purging operation by moving the cleaning blade.

10. The method according to claim 9, further comprising: treating the inkjet head bottom to have a hydrophobic property.

11. The method according to claim 10, further comprising: treating at least one surface of the elongated groove in the cleaning blade to have a hydrophilic property.

12. The apparatus according to claim 8, wherein the elongated groove has a length greater than an arrangement length of all nozzles at the inkjet head bottom.

* * * * *